United States Patent [19]

Hendry

[11] Patent Number: 4,503,354

[45] Date of Patent: Mar. 5, 1985

[54] CAMERA TUBES

[75] Inventor: Eric D. Hendry, Chelmsford, England

[73] Assignee: English Electric Valve Company Limited, Chelmsford, England

[21] Appl. No.: 325,187

[22] Filed: Nov. 27, 1981

[30] Foreign Application Priority Data

Nov. 27, 1980 [GB] United Kingdom ..... 8038070

[51] Int. Cl.[3] ..... H01J 31/38

[52] U.S. Cl. ..... 313/382; 313/389

[58] Field of Search ..... 313/382, 389, 365

[56] References Cited

U.S. PATENT DOCUMENTS 2,892,962 6/1959 Ross ..... 313/382 X 3,471,741 10/1969 Cope et al. ..... 313/382 X 3,866,079 2/1975 Schut ..... 313/389

FOREIGN PATENT DOCUMENTS 853078 11/1960 United Kingdom .

*Primary Examiner*—David K. Moore

*Assistant Examiner*—K. Wieder

*Attorney, Agent, or Firm*—Spencer & Frank

[57] ABSTRACT

A photoconductive target camera tube provided to operate within a solenoid producing a uniform magnetic focusing field has a grid with a beam width defining aperture therein between the electron gun and the normally provided cylindrical anode. The aperture grid is mounted upon a ring of magnetic material which acts to reduce the magnitude of the focusing magnetic field at the plane of the aperture so to achieve a demagnification of the image of the aperture at the target with a consequent reduction in the beam spot size.

5 Claims, 2 Drawing Figures

CAMERA TUBES

BACKGROUND OF THE INVENTION

This invention relates to camera tubes and in particular to camera tubes of the photoconductive target type, such as, for example, vidicon camera tubes.

A typical camera tube of the above type as at present known is illustrated in FIG. 1 which shows a longitudinal cross section of the tube. Referring to FIG. 1 the tube consists of a glass envelope 1 having a face plate 2. On the inner surface of the face plate 2 is the target electrode 3. The customary target ring is referenced 4. At the other end of the tube the base of which is shown broken away is an electron gun 5 which in operation projects an electron beam down the length of the tube towards the target 3.

At the output end of the electron gun 5 are the first and second grids (normally referred to as G1 and G2) here referenced 6 and 7 respectively. Grid 7, an accelerating grid electrode, has therein a beam width defining aperture 8.

Following grid 7 is a cylindrical anode 9 (commonly referred to as G3). At the end of the cylindrical anode 9 towards the target 3 is a mesh 10 normally referred to as the terminating mesh extending across a carrier 11.

While not shown in FIG. 1 the tube is provided to be operated within a solenoid producing a magnetic focusing field in the direction of the axis of the tube.

With a typical vidicon camera tube as illustrated in FIG. 1 the resolution achieved is a function of the electron beam spot size at the target 3. This in turn is related to the size of the defining aperture 8 in the second grid 7 and the demagnification of the image of this aperture at the target 3. Demagnification is a function of $H_A/H_T$ where $H_A$ is the magnitude of the focusing magnetic field at the plane of the aperture 8 and $H_T$ is the magnitude of the focusing magnetic field in the plane of the target 3.

In a uniform magnetic field as normally produced by the focusing solenoid $H_A/H_T=1$ and therefore no demagnification occurs.

SUMMARY OF THE INVENTION

One object of the present invention is to provide an improved vidicon camera tube in which demagnification is achieved whilst operating within a solenoid producing a magnetic focusing field which may be substantially uniform.

According to this invention, an electronic camera tube having an electron gun and a target and provided for operation within a solenoid producing a magnetic focusing field includes magnetic means adjacent a beam defining aperture which magnetic means acts in operation locally to reduce said magnetic field in the plane of said aperture and thereby the size of the beam spot at said target.

As is the case with known arrangements, the magnetic focusing field produced by said solenoid will normally be a uniform magnetic field.

Preferably said magnetic means is provided in the form of a continuous ring of magnetic material through which the electron beam from said gun passes in operation.

Preferably said camera tube is a photoconductive target camera tube having a cylindrical anode electrode and said magnetic means is a continuous ring of magnetic material surrounding the exit of said beam defining aperture which aperture is provided in an accelerating grid electrode provided between said electron gun and the entrance to said cylindrical anode electrode.

Preferably said continuous ring supports said accelerating grid electrode.

DESCRIPTION OF THE PREFERRED EMBODIMENT

Figure 1:
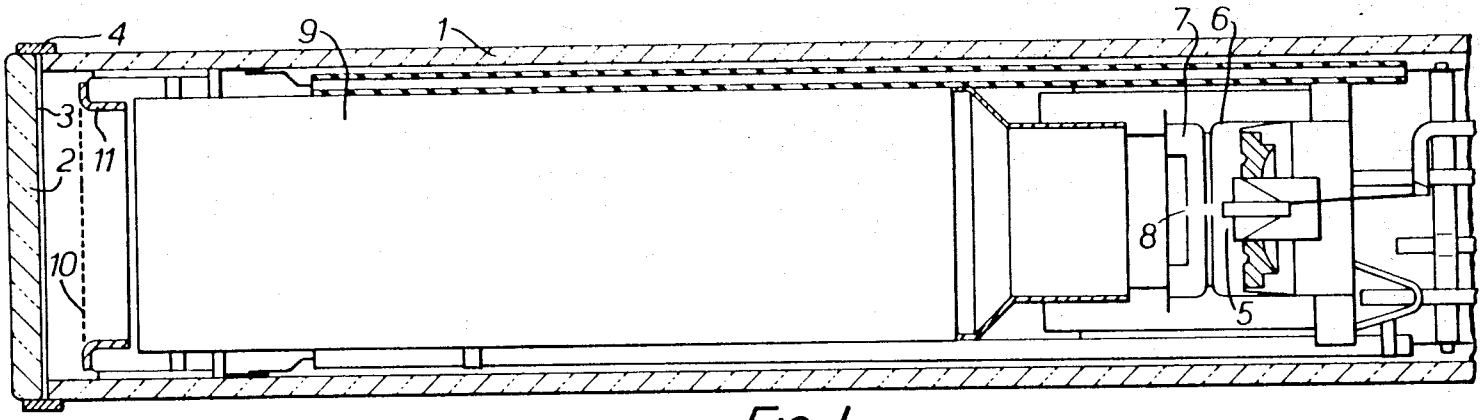
FIG. 1 is a longitudinal sectional view of a camera tube according to the prior art.
Figure 2:
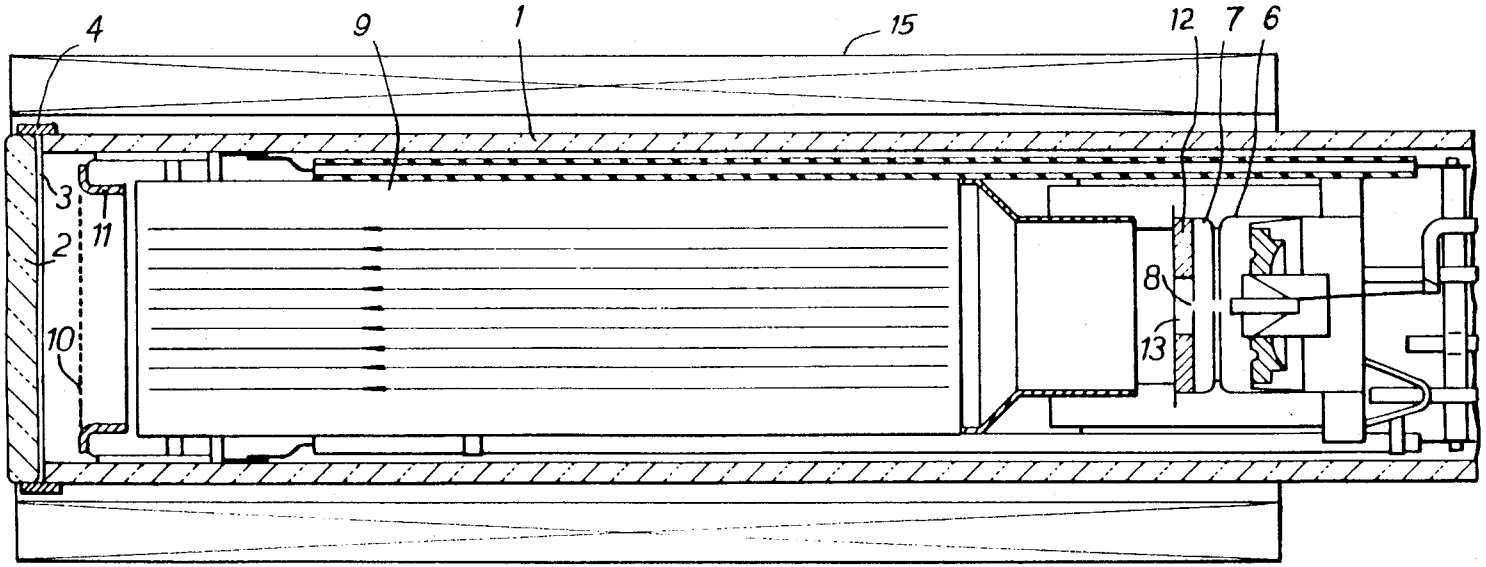
FIG. 2 shows a longitudinal sectional view through one example of photoconductive target camera tube in accordance with the present invention.

It will be noted that in most respects the camera tube illustrated in FIG. 2 is identical to that illustrated in FIG. 1 and like references are used to denote like parts.

Referring to FIG. 2 it will be seen that the only difference between this and the known tube illustrated in FIG. 1 resides in the nature of the grid structure 7 containing the beam width defining aperture 8. The accelerating grid electrode 7 is now mounted upon a continuous ring 12 of magnetic material. The ring 12 is positioned to surround the exit of aperture 8 towards the entrance of the cylindrical anode 9 so that the beam passes first through aperture 8 in grid 7 and then through the aperture 13 in the ring 12.

The effect of the ring 12 of magnetic material is to reduce the value of $H_A$, that is to say the magnitude of the focusing magnetic field at the plane of the aperture 8. This causes the demagnification of the image of the aperture 8 at the plane of the target 3 and hence the reduction in the beam spot size at the target 3 compared to that which would be the case if the ring 12 were not magnetic material or if the grid 7 was identical to that shown in FIG. 1.

FIG. 2 also shows a solenoid 15 for producting the magnetic focusing field within which the electron gun and target are operated.

I claim:

1. An electronic camera tube having a longitudinal axis, and including an electron gun and a target which are provided for operation within a solenoid producing a magnetic focusing field, and a magnetic means adjacent a beam defining aperture, the aperture having a sectional plane perpendicular to the longitudinal axis of the tube, said magnetic means acting in operation locally to reduce said magnetic focusing field in the sectional plane of said aperture and thereby the size of the beam spot at said target.

2. A tube as claimed in claim 1 and wherein said magnetic means is provided in the from of a continuous ring of magnetic material through which the electron beam from said gun passes in operation.

3. A tube as claimed in claim 1 and wherein said tube is a photoconductive target camera tube having a cylindrical anode electrode and said magnetic means is a continuous ring of magnetic material surrounding the exit of said beam defining aperture which aperture is provided in an accelerating grid electrode provided between said electron gun and the entrance to said cylindrical anode electrode.

4. A tube as claimed in claim 3 and wherein said continuous ring of magnetic material supports said accelerating grid electrode.

5. An electronic camera tube having a longitudinal axis and comprising: a target; an electron gun having an output for projecting an electron beam towards said target for producing a beam spot on said target; a solenoid for producing a magnetic focusing field, said target and said gun disposed for operation within said field; a grid structure disposed at the output of said gun and containing a beam width defining aperture, said aperture having a sectional plane perpendicular to the longitudinal axis of the tube; and magnetic means adjacent the aperture for reducing the magnitude of said magnetic focusing field in the sectional plane of the aperture.

* * * * *